United States Patent [19]

Fry et al.

[11] 4,301,761

[45] Nov. 24, 1981

[54] DEPTH AND HOVER CONTROL SYSTEM FOR UNMANNED UNDERWATER VEHICLE

[75] Inventors: Harold E. Fry, Chatsworth; Arnold L. Peters, Burbank, both of Calif.

[73] Assignee: The United States of America as represented by the Secretary of the Navy, Washington, D.C.

[21] Appl. No.: 152,449

[22] Filed: May 22, 1980

[51] Int. Cl.[3] ..... B63G 8/14; B63G 8/22; B63G 8/24

[52] U.S. Cl. ..... 114/331; 9/8 R

[58] Field of Search ..... 9/8 R; 367/17, 18, 172, 367/167; 114/293, 121, 294, 124, 331, 125, 333; 102/13, 15; 89/1 B

[56] References Cited

U.S. PATENT DOCUMENTS

| | | | |
|---|---|---|---|
| 3,004,507 | 10/1961 | Abrams | 114/25 |
| 3,048,814 | 8/1962 | Francois | 9/8 R |
| 3,180,297 | 4/1965 | Schink | 114/25 |
| 3,228,369 | 1/1966 | Warhurst | 114/331 |
| 3,570,437 | 3/1971 | Davis | 9/8 R |
| 3,708,812 | 1/1973 | Yapoudjian | 114/221 |
| 3,728,934 | 4/1973 | Palmer | 89/1 |
| 4,007,505 | 2/1977 | Nowatzki | 9/8 R |
| 4,197,806 | 4/1980 | Laxo | 114/331 |

*Primary Examiner*—Trygve M. Blix
*Assistant Examiner*—Thomas J. Brahan
*Attorney, Agent, or Firm*—Richard S. Sciascia; Harvey A. David

[57] ABSTRACT

In an unmanned underwater instrumentation vehicle, travel to an assigned depth and cyclical excursions between depth tolerances above and below that depth are effected by a mechanism that alternatively drops vernier weights by firing explosive release bolts and floods buoyancy chambers by firing explosive piercing cartridges.

11 Claims, 8 Drawing Figures

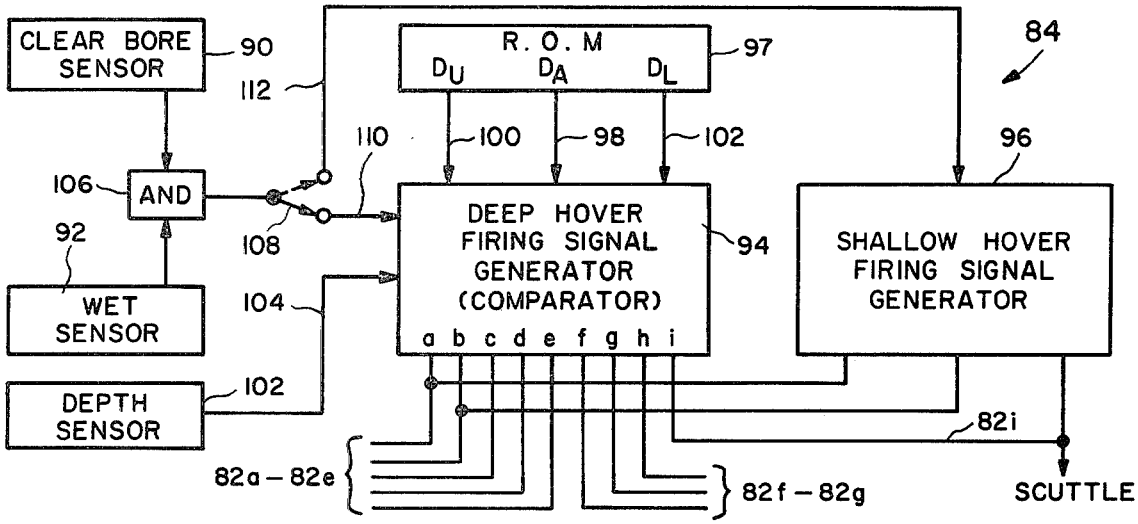
FIG. 4
FIG. 5a
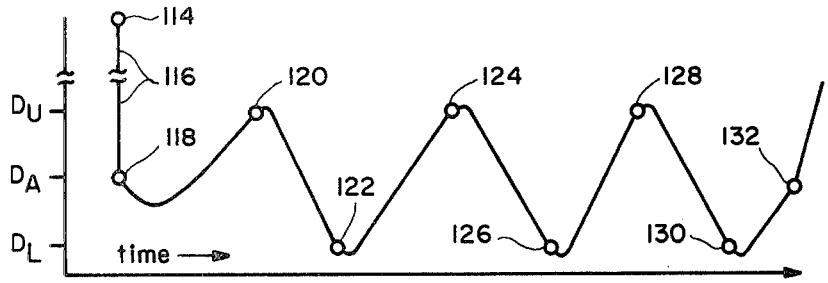
FIG. 5b
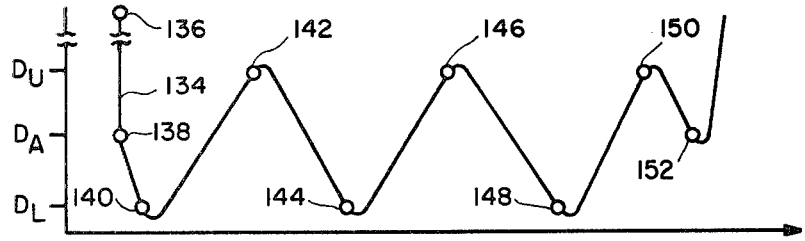
FIG. 5c
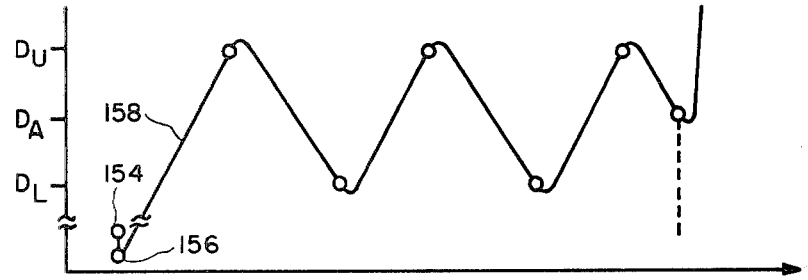
FIG. 5d
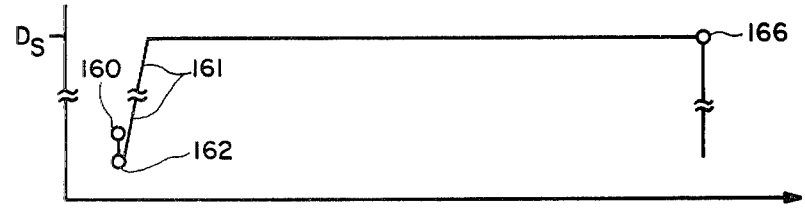

DEPTH AND HOVER CONTROL SYSTEM FOR UNMANNED UNDERWATER VEHICLE

BACKGROUND OF THE INVENTION

This invention relates to unmanned underwater vehicles and more particularly to the control thereof so as to operate substantially in a hovering mode. Certain unmanned underwater vehicles, for example carrying scientific or other instrumentation, have a requirement to operate at two or more depths and to maintain the ordered depth, within certain tolerances for a specified period of time.

Among the approaches used heretofore for obtaining hovering control are propellors driven by variable speed motors, alternation of intermittent periods of propellor driven ascent and drogue delayed descent as shown in U.S. Pat. No. 4,007,505, by controlling discharge of heavy and light liquid to increase or decrease buoyancy as shown in U.S. Pat. No. 3,228,369, and by flooding and blowing of chambers as shown in U.S. Pat. No. 3,180,297.

In addition, it is known to increase buoyancy of an underwater vehicle by discharge or dropping of weights, often in the form of shot, as shown in U.S. Pat. No. 3,004,507. Since the dropping of a weight is an irreversible action, this expedient has generally been confined to a one time event, such as for the recovery of a spent practice torpedo at the end of its run, rather than for effecting hovering control at an assigned depth.

The mentioned known hovering systems have a variety of drawbacks or shortcomings when applied to an expendable unmanned instrumentation vehicle that is required to be stored for considerable period of time and then deployed and required to operate reliably for a predetermined, relatively short period of time. Then shortcomings include complex and expensive controls, noise of motors and pumps, requirement of substantial energy storage, size constraints, and limited reliability after prolonged periods of non-use.

SUMMARY OF THE INVENTION

With the foregoing in mind, it is a principal object of this invention to overcome most or all of the drawbacks and shortcomings of the prior art through the provision of a novel and improved hovering control system particularly adapted to the mentioned requirements of storage capability and subsequent reliability for the desired operating periods.

As another object the inventin aims to provide a relatively inexpensive and effective depth determining and hovering system for an unmanned, underwater instrumentation vehicle that utilizes a novel combination of releasable weights and floodable compartments to achieve a hovering mode between predetermined upper and lower depth limits.

Still another object is the provision of a vehicle hovering control system of the foregoing character and wherein a program of events is carried out with utilization minimum of stored electrical energy.

Yet another object is to accomplish changes in buoyancy, either increase or decrease through the activation of explosive elements to effect release of predetermined ballast weights or flooding of compartments.

The invention may be further said to reside in certain novel constructions, combinations, and arrangements of parts by which the foregoing objects and advantages are achieved, as well as others which will become apparent from the following detailed description of a preferred embodient when read in conjunction with the accompanying drawings.

DESCRIPTION OF THE DRAWINGS

FIG. 4 is a diagrammatic illustration, in block form, of the control programmer portion of the system; and FIGS. 5*a*–5*d* are graphic illustratons of operating sequences of the vehicle embodying the invention.

DESCRIPTION OF THE PREFERRED EMBODIMENT

Figure 1:
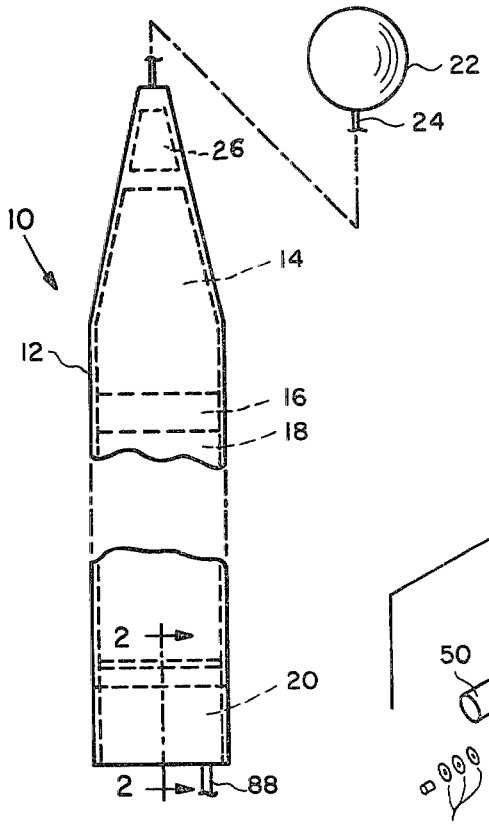
FIG. 1 is a side elevational view of an underwater instrumentation vehicle incorporating a depth determining and hovering system according to the invention.

In the form of the invention illustrated in the drawigns, and with reference initially to FIG. 1, an underwater vehicle 10 comprises an elongated body 12 containing an instrumentation section 14, a program controller section 16, a battery or other energy supply section 18, and a depth determining and hovering control section 20. The vehicle 10, in this example, includes means in the form of a float 22 and tether 24 for providing additional buoyant forces to the end of the body 12 opposite the hovering control section 20 so that the vehicle body normally assumes an orientation in the water with the long axis substantially vertical and the hovering control section pointed down. A scuttling means 26, for example an electrically actuated explosive device, is provided for separating the buoy 22 from the vehicle in certain circumstances after a hovering operation.

Figure 3:
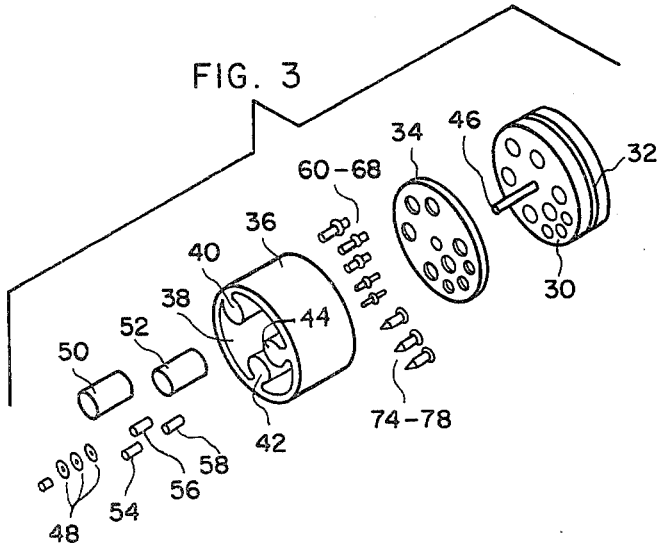
FIG. 3 is an exploded perspective view of principal mechanical components of the system of FIG. 2.
Figure 2:
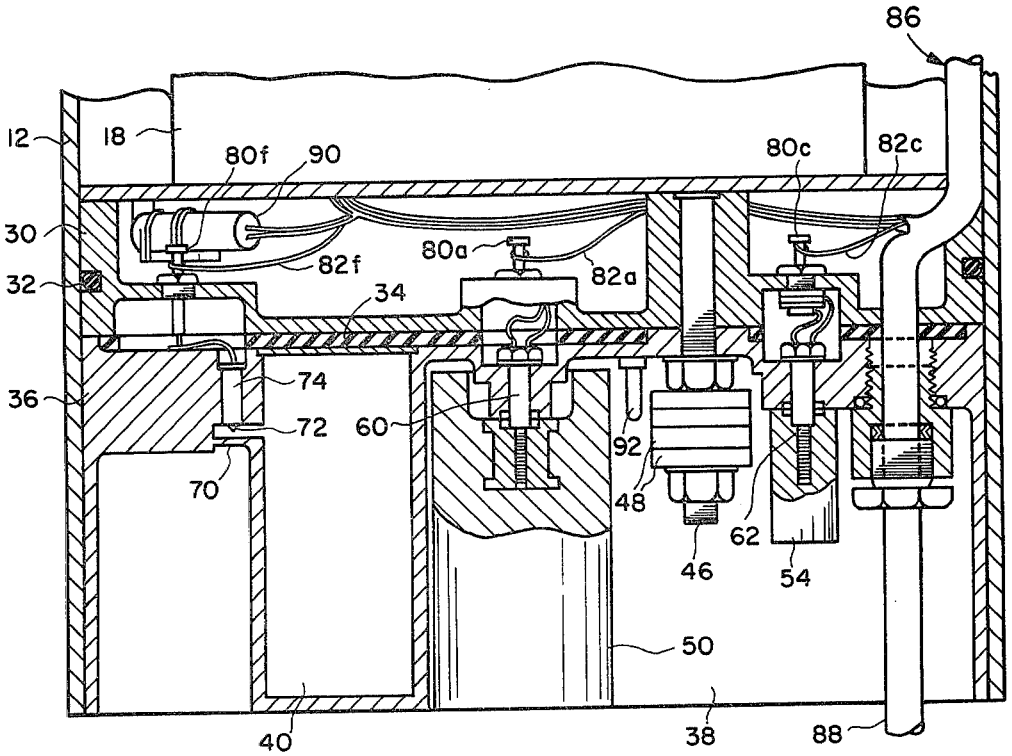
FIG. 2 is a vertical sectional view, on an enlarged scale, of the hovering system of the vehicle of FIG. 1.

Referring now to FIGS. 2 and 3, the lower or hovering control end of the body 12 comprises a cylindrical wall formed of a suitable rigid material housing the hovering control section components including a circular front member 30, in the form of a casting defining a plurality of terminal cavities and carrying an O-ring 32 as a seal between the battery and hovering control sections.

Disposed against the front member 30, with an interfacial gasket 34 therebetween, is a generally cylindrical rear member 36, conveniently in the form of a casting defining a weight receiving recess and a plurality of floodable cavities or chambers 40, 42, and 44. The front and rear members or castings 30, 36 are fixed together by a bolt 46. Carried on the bolt 46 are a plurality of buoyancy trimming weights in the form of washers 48, the purpose of which will presently be made apparent.

Releasably fastened in the cavity 38 are two heavier weights 50 and 52, and three lighter weights 54, 56, and 58. These weights are secured by electrically actuable, explosive release bolts 60–68. Each of the three floodable chambers 40, 42, and 44 are normally empty of water but, as is shown with respect to chamber 40 in FIG. 2, are adapted to become flooded upon piercing of a thin wall segment 70 by a pointed, hollow, piercing element 72 forming part of an electrically actuable, explosive piercing cartridge 74, 76, or 78. The explosive release bolts 60–68 and the explosive piercing cartridges 74–78 are mounted on the rear member 36 and are electrically connected to corresponding terminals 80*a*–80*h* which are, in turn, connected by suitable conductors 82*a*–82*h* to a program controller 84, discussed later with reference to FIG. 4. The conductors 82*a*–82*h* from part of a wiring harness generally indicated at 86 and including an electrical umbilical cable 88 by which certain program selections can be made prior to deployment of the vehicle 10. Upon release of the vehicle, the umbilical cable 88 is severed without destroying the program selection.

A cleared bore sensing magnetic switch 90 and a wet sensor 92 are provided and must both be actuated upon deployment of the vehicle to initiate operation of the hovering control system.

During assembly of the hovering control section 20, weights 48 of appropriate size and number are added to bolt 46 to provide the vehicle, including the tethered float 22, with an initial buoyancy that is, as nearly as is practicably possible, negative by the same amount as one of the two larger weights 50, 52 weighs in water, say 2.5 lbs.

The smaller releasable weights 54–58 each weigh considerably less in water, say 2.5 oz. while the floodable chambers 40–44 are each of a size that, when flooded, adds about 2.5 oz. of negative bouyancy.

Referring now to FIG. 4, the program controller 84 comprises a deep hover firing signal generator which is conveniently in the form of a conventional comparator 94, and a shallow hover firing signal generator 96, which may conveniently comprise a relay or one-shot device.

The comparator 94 is provided with reference signal conditions stored in a read only memory device 97 and represented by lines 98, 100, and 102, corresponding to an assigned deep hover depth $D_A$ and the upper and lower tolerance depths $D_U$ and $D_L$, between which the vehicle is to hover, while a pressure repsonsive depth sensor 102 provides an input 104 to the comparator representative of actual vehicle depth.

The clear bore sensor 90 and the wet sensor 92 have their outputs applied, as shown, to a coincidence gate 106, the output of which is applied via a shallow/deep selection relay contactor 108 to enable either the deep hover comparator 94 via line 110 or the shallow hover firing signal generator 96 via line 112 depending upon the position of the contactor 108.

Referring now to FIGS. 5*a*–5*d*, consider the vehicle 10 to have been released at a depth indicated at 114 considerably above the assigned deep hovering depth $D_A$. Upon actuation of the cleared bore and wet sensors 90,92, the program controller 84 is enabled to begin monitoring the vehicle depth as above or below the depth $D_A$. In this instance, the vehicle being well above $D_A$ and having an initial negative buoyancy of some 2.5 lbs., the vehicle plummets, as shown by curve 116 toward depth $D_A$. Upon passing depth $D_A$, the comparator 94 generates a firing signal, at point 118 on curve 116, via conductor 82*a* to fire explosive release bolt 60 and drop the first larger weight 50. The result is to render the vehicle nearly neutrally buoyant. In this example, consider the vehicle to have become slightly positively buoyant at point 98, by say less than 2.5 oz. The vehcile will cease to plummet and, after a slow turning period, begin to rise slowly as indicated by the slope of curve 116.

When the vehicle rises to depth $D_U$, the program controller generates a firing signal on line 82*f*, which event is indicated at point 120, thereby firing piercing cartridge 74 to flood chamber 40 and render the buoyancy of the vehicle more negative by 2.5 oz. to achieve a net buoyancy of something less than 2.5 oz. negative. Accordingly, the vehicle will slowly reverse its ascent and slowly sink toward depth $D_L$. Upon arrival at that depth, the program controller 84 will fire explosive release bolt 62, via conductor 82*c*, so as to release the first smaller 2.5 oz. weight 54 at point 122, therefore resulting in a net positive buoyancy of less than 2.5 oz.

The procedure is repeated through points 124, 126, 128 and 130, alternately dropping small weights and flooding chambers so as to cause the vehicle to cylcally rise and fall between the tolerance limits above and below the assigned depth. At some point 132 after the last small weight has been dropped and the last small chamber flooded, the program controller fires explosive bolt 68 via conductor 82*b* to release the second large weight 52 so as to effect a substantial positive buoyancy in the vehicle which will then rise rapidly to the surface for recovery. Alternatively, the program controller can be pre-programmed to actuate an explosive device (not shown) via conductor 82*i* to sever the connection of the tether 24, thereby scuttling the vehicle proper.

FIG. 5*b* shows by curve 134 the sequence of events when the vehicle is activated at a depth 136 considerably above the assigned depth $D_A$ and but remains slightly negative in buoyancy after release of the first heavier weight 50 at point 138. The vehicle sinks at a slower rate to the lower tolerance depth $D_L$ where the first smaller weight 54 is dropped at point 140 to reverse the buoyancy and cause the vehicle to slowly rise toward the upper tolerance depth. At point 142 the piercing cartridge for the first flooding chamber is fired and the vehicle again becomes slightly negative and sinks toward the lower tolerance depth. Subsequent hovering control events and scuttling or recovery events are indicated at points 144–152.

FIG. 5*c* illustrates a variation wherein the vehicle is activated at a point 154 well below the assigned depth and almost immediately, at point 156, drops one of the heavier weights and a smaller weight so as to rise, as shown by curve 158 toward the upper tolerance depth $D_U$, wherafter it follows cylical hovering pattern similar to those already described.

On occasion it may be desirable to have the vehicle rise to a predetermined relatively shallow hovering depth. In such a case, upon activation, the controller 84 having been conditioned by positioning of the contactor 108 to the shallow position, shortly after activation at a point 160, fires the release bolts to drop both of the heavier weights at point 162, causing the vehicle to rise rapidly as shown by curve 161, until the float means 22 reaches the surface and the vehicle is suspended at the desired shallow hovering depth $D_S$ as determined by the length of the tether 24. After a predetermined time period, the program controller 84 can, if so preset, provide a signal via line 82*i* to effect scuttling as indicated by event point 166.

From the foregoing description, it will be appreciated that the invention has provided an unmanned underwater vehicle hovering control system that will readily meet the aforementioned objects and advantages, as well as others apparent herefrom.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A hovering control system in combination with an underwater vehicle for causing said vehicle to seek a predetermined assigned depth and to hover about said depth, said system comprising:

body means defining a plurality of normally closed, initially empty chambers, each adapted to be flooded by a predetermined volume of water;

vernier weight means including at least one large weight member of first predetermined weight in water and a plurality of small weight members each of a second predetermined weight in water substantially equal to the weight of said predetermined volume of water;

said vehicle and control system initially having a negative buoyancy substantially equal to said first predetermined weight in water of said large weight member whereby upon initial deployment of said vehicle it will begin to plummet;

control means, responsive to predetermined depth conditions, for causing said weight members to be dropped and said chambers to be flooded in a sequence that will alternate said vehicle between positive and negative buoyancy states whereby said vehicle will hover by cyclical travel substantially between an upper tolerance depth and a lower tolerance depth.

2. A system as defined in claim 1, and wherein said control means comprises:

retainer means for releasably securing said weight members to said body means and selectively dropping of said weight members;

flooding means for selectively opening said chambers for flooding; and programmer means responsive to predetermined depth conditions to effect actuation of said retainer means and said flooding means so as to effect said sequence.

3. A system as defined in claim 2, and wherein:

said retainer means comprise electrically actuable explosive bolts; and said flooding means comprise electrically actuable explosive piercing devices.

4. A system as defined in claim 3, and wherein said programmer means comprises:

depth sensor means for providing depth signals representative of depth of said vehicle;

storage means for providing reference conditions corresponding to said assigned depth and to upper and lower tolerance depths above and below said assigned depth; and comparator means responsive to said depth signals and said reference conditions for generating firing signals for actuation of said retainer means and said flooding means in said sequence.

5. A system as defined in claim 4, and wherein said weight means comprises a second large weight member and said programmer means is responsive to a predetermined depth condition after flooding of the last of said chambers and dropping of the last of said small weights to effect dropping of said second large weight so as to cause said vehicle to rise to the water surface for recovery.

6. A system as defined in claim 4, and further comprising scuttling means for producing a large negative buoyancy in said vehicle, said programmer means being responsive to a predetermined depth condition after flooding of the last of said chambers and dropping of the last of said small weights to effect actuation of said scuttling means so as to scuttle said vehicle.

7. In combination with an unmanned underwater instrumentation vehicle, a hovering control system for causing said vehicle to selectively operate in either a shallow hover mode about a predetermined shallow depth or a deep hover mode about a predetermined deep hover assigned depth, said system comprising:

float means connected by tether means of predetermined length to said vehicle, said length to corresponding to said predetermined shallow depth;

body means defining a plurality of normally closed, initially empty buoyancy chambers, each adapted to be flooded by a predetermined volume of water;

vernier weight means including at least a first large weight member of first predetermined weight in water and a plurality of small weight members each of a second predetermined weight in water substantially equal to the weight of said predetermined volume of water;

retainer means for releasably securing said weight members to said body means and actuable to selectively drop said weight members;

flooding means actuable to open said chambers selectively for flooding by ambient water;

said vehicle and float means having an initial negative buoyancy substantially equal to said weight in water of said large weight member will render said vehicle and float means substantially neutrally buoyant;

deployment sensor means, responsive to deployment of the vehicle in a body of water, for generating a deployment signal;

mode selector means conditionable to respond to provide shallow or deep hover enabling signals in response to said deployment signal; and programmer means, responsive to said enabling signals and to predetermined water pressure conditions, for effecting actuation of said retainer means and said flooding means so as to cause said vehicle to either rise to and hover about said shallow hover depth or to travel to and hover about said deep hover assigned depth.

8. The combination defined in claim 7, and wherein:

said programmer means comprises a first signal generator for generating deep hover firing signals and a second signal generator for generating shallow hover firing signals;

said retainer means and said flooding means comprise pyrotechnic devices responsive to said firing signals; and said combination comprises sensor means for providing said mode selector means with a deployment signal corresponding to deployment of said vehicle in a body of water.

9. The combination defined in claim 7, and wherein:

said programmer means comprises pressure responsive depth sensing means and deep hover firing signal generator means responsive to said deep hover enabling signal to generate weight release and chamber flooding firing signals in response to predetermined reference depth conditions.

10. The combination defined in claim 8 and wherein:

said vernier weight means comprises a second large weight member having a weight in water substantially equal to said first large weight member;

said programmer means further comprises shallow hover firing signal generator means responsive to said shallow hover enabling signal to generate firing signals for effecting release of both of said first and second large weight members.

11. The combination defined in claim 9, and further comprising:

scuttling means, for separating said float means from said vehicle after hovering for a predetermined period at said shallow hover depth.

* * * * *